United States Patent [19]

Jacobsson

[11] Patent Number: 4,607,994

[45] Date of Patent: Aug. 26, 1986

[54] TRANSPORT ARRANGEMENT ESPECIALLY FOR LINING MATERIAL

[75] Inventor: Paul Jacobsson, Skärholmen, Sweden

[73] Assignee: Tellus Maskin AB, Vallentuna, Sweden

[21] Appl. No.: 492,960

[22] Filed: May 9, 1983

[30] Foreign Application Priority Data

May 17, 1982 [SE] Sweden ..... 8203095
Apr. 8, 1983 [SE] Sweden ..... 8301965

[51] Int. Cl.[4] ..... E04G 21/14; F27D 1/16

[52] U.S. Cl. ..... 414/10; 52/187; 182/49; 182/128; 266/281

[58] Field of Search ..... 414/10; 193/12, 13, 193/35 A; 266/281; 52/187; 182/49, 128

[56] References Cited

U.S. PATENT DOCUMENTS

| | | | |
|---|---|---|---|
| 144,133 | 10/1873 | Pfund | 193/12 X |
| 403,742 | 5/1889 | Dodge | 193/12 X |
| 817,341 | 4/1906 | Schwab | 193/12 |
| 849,340 | 4/1907 | Schwab | 193/12 |
| 1,050,272 | 1/1913 | Hamilton | 193/13 X |
| 3,033,389 | 5/1962 | Abarotin et al. | 182/128 X |
| 3,439,794 | 4/1969 | Park et al. | 182/128 |
| 3,667,176 | 6/1972 | MacKay | 52/187 |
| 3,888,062 | 6/1975 | Gregord et al. | 182/128 X |
| 4,253,558 | 3/1981 | Roeing et al. | 193/35 A |
| 4,303,363 | 12/1981 | Cervin | 414/10 |

FOREIGN PATENT DOCUMENTS 567664 12/1923 France .

*Primary Examiner*—Robert J. Spar
*Assistant Examiner*—Janice Krizek
*Attorney, Agent, or Firm*—Nies, Webner, Kurz & Bergert

[57] ABSTRACT

An arrangement for transporting wall material, for example, shaped bricks for the lining of ladles, converters, blast furnaces or the like, where the transport is intended to take place between a supply place, usually located outside the converter or corresponding apparatus, and a consumption place, for example a bricklaying station adjacent an inner wall in the converter or corresponding apparatus, which arrangement comprises a vertically adjustable carrying device and a conveying device for substantially vertical transport of material transferred to the conveying device, and transfer mechanism is provided for advancing material transported down by the conveyor onward to the consumption space, and a work platform is provided to be carried by the carrying device. The arrangement as disclosed shows the conveying device as a substantially helical slither plate, e.g., a chute or corresponding slide device, along which material supplied at an upper portion of the helical plate is intended to slide.

16 Claims, 15 Drawing Figures

Figure 1:
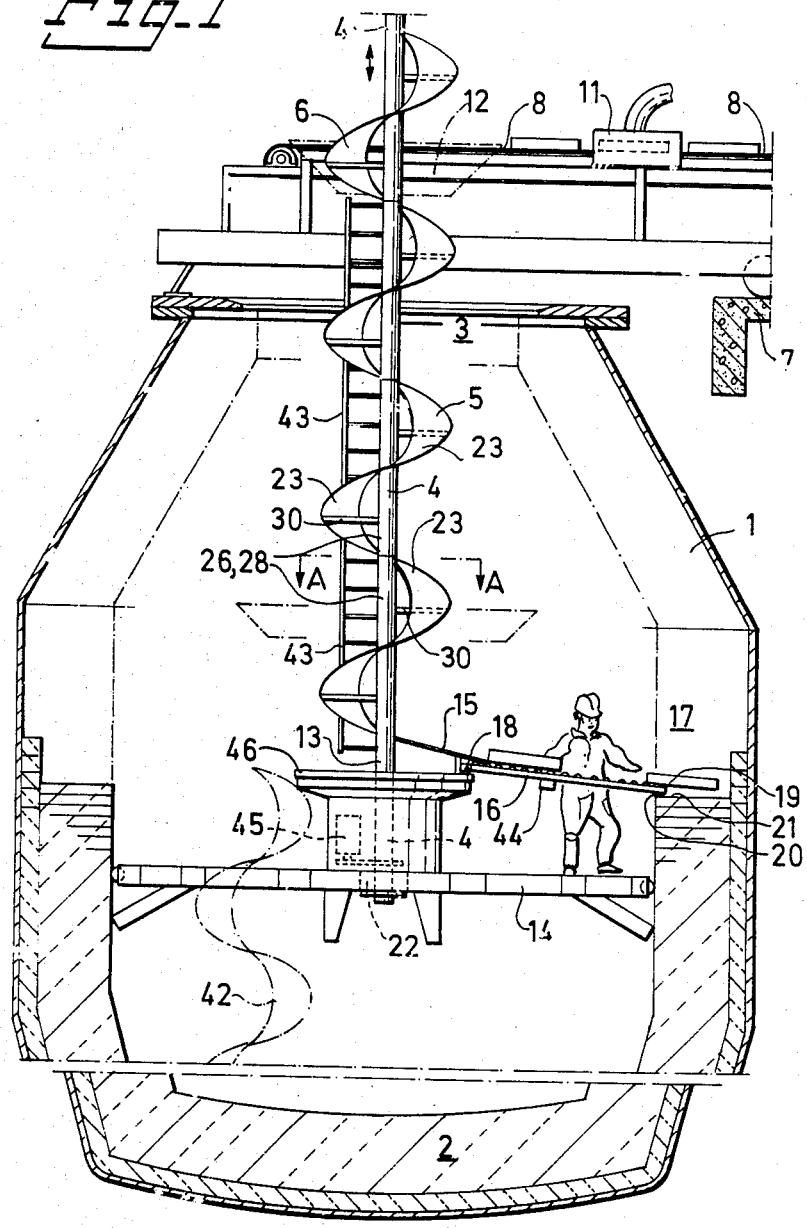

Fig. 7
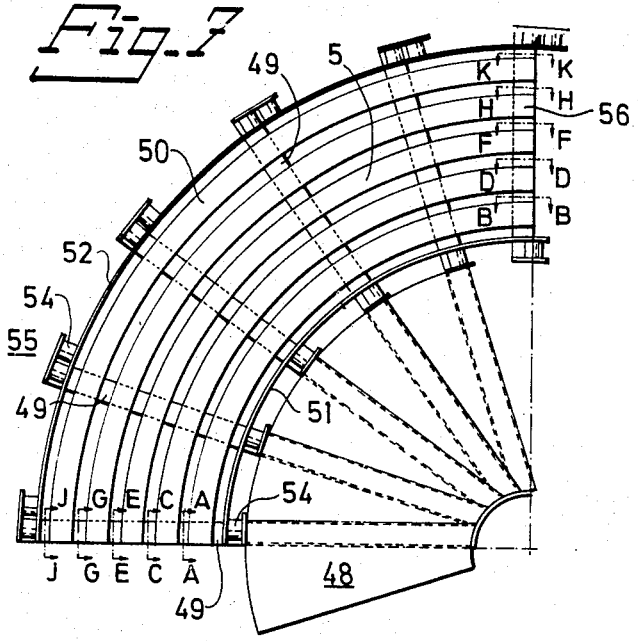
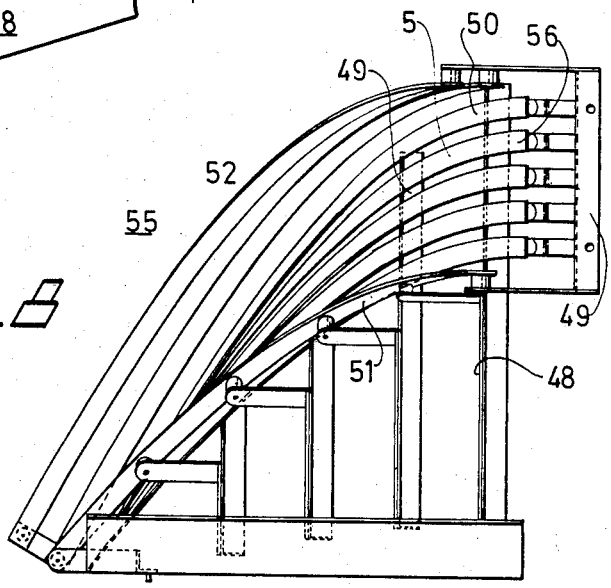
Fig. 8
Fig. 9
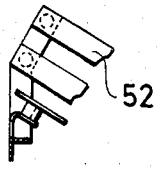
Fig. 10
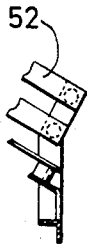

TRANSPORT ARRANGEMENT ESPECIALLY FOR LINING MATERIAL

This invention relates to an arrangement for the transport of especially wall material, for example shaped bricks for the lining of metallurgical furnaces and heating apparatuses such as ladles, converters, blast furnaces or the like, comprising a carrying device and a conveying device for transporting the material substantially vertically in the converter or corresponding apparatus, and comprising means for transporting material to a place of consumption, usually a bricklaying station adjacent an inner wall, and a work platform supported at least among other things, by said carrying device.

Arrangements of the aforesaid kind are known previously. One such known arrangement comprises a substantially vertical carrying device and a vertically adjustable tower supported by said carrying device and carrying at one end said platform. Conveying means are provided for advancing material through the tower to a transfer station, and a roller conveyor transports the material substantially radially from the transfer station to a place near the inner circumference of the converter or corresponding apparatus. The transfer station comprises a transfer conveyor supported by the tower above the platform. Said transfer conveyor is capable of moving material received in the transfer station from the vertical conveyor in a circular conveying path relative to the tower and work platform. The roller conveyor comprises a radial roller table with roller way and extends radially from the outer circumference of the circular conveying path of the transfer conveyor and is carried by the tower above the platform, and is movable relative to the platform and tower, and can be moved manually on a circular path, so that its inner end is moved about the outer circumference of the conveying path of the transfer conveyor, so that the roller table hereby is movable about the tower and in relation to the platform and inner circumference of the heating apparatus.

An arrangement of the aforesaid kind involves disadvantages. The arrangement is expensive and, due to its great number of mounted and movable partial components, sensitive in view of, among other things, the great amount of dust and brick particles it is exposed to. The movably mounted tower constitutes a safety risk, and substantial expenditures must be made for bringing about acceptable safety. Moreover, the number of handling steps is considerable.

The present invention relates to an arrangement for mainly corresponding purposes which is much simpler and thereby less expensive than known arrangements, and which is much less sensitive and, from a safety aspect, much more attractive than known arrangements, and at which the number of handling steps is low.

The present invention, thus, relates to an arrangement for transporting primarily wall material, for example shaped bricks for the lining of ladles, converters, blast furnaces and the like, where the transport is intended to take place between a supply place, which usually is located outside the converter to corresponding apparatus, and a consumption place, for example a bricklaying station located adjacent an inner wall in the converter or corresponding apparatus, which arrangement comprises a vertically adjustable carrying device and a conveying device for substantially vertical transport of material transferred to the conveying device, devices for advancing to the consumption place material conveyed down by said conveying device, and a work platform supported at least, among other things, by said carrying device.

The arrangement according to the invention is especially characterized in that said conveying device is a substantially helical slither plate, chute or corresponding means, a slide, along which material supplied at an upper portion thereof is intended to slide down.

Figure 2:
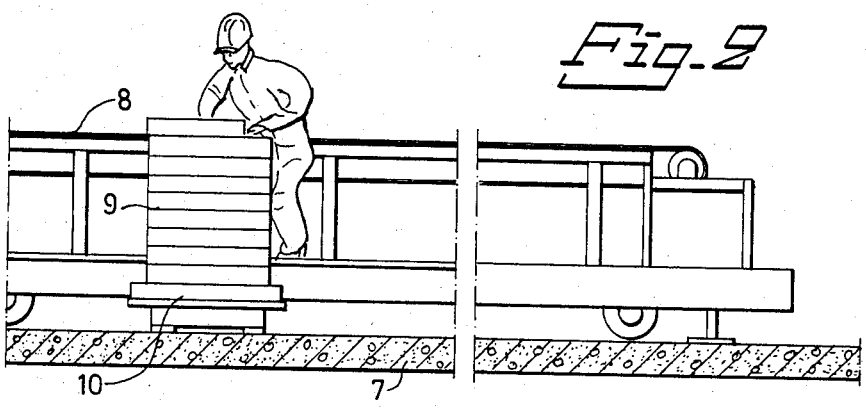
Figure 3:
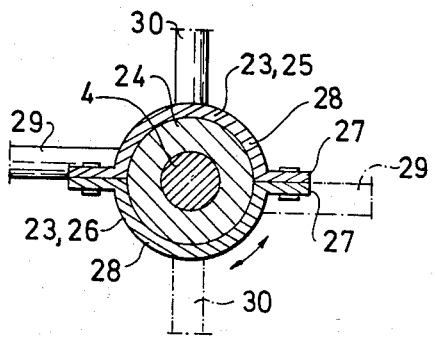
Figure 4:
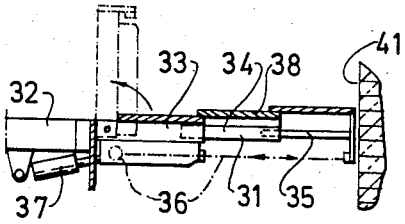
Figure 5:
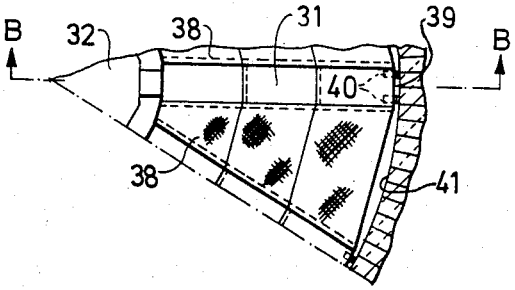
Figure 6:
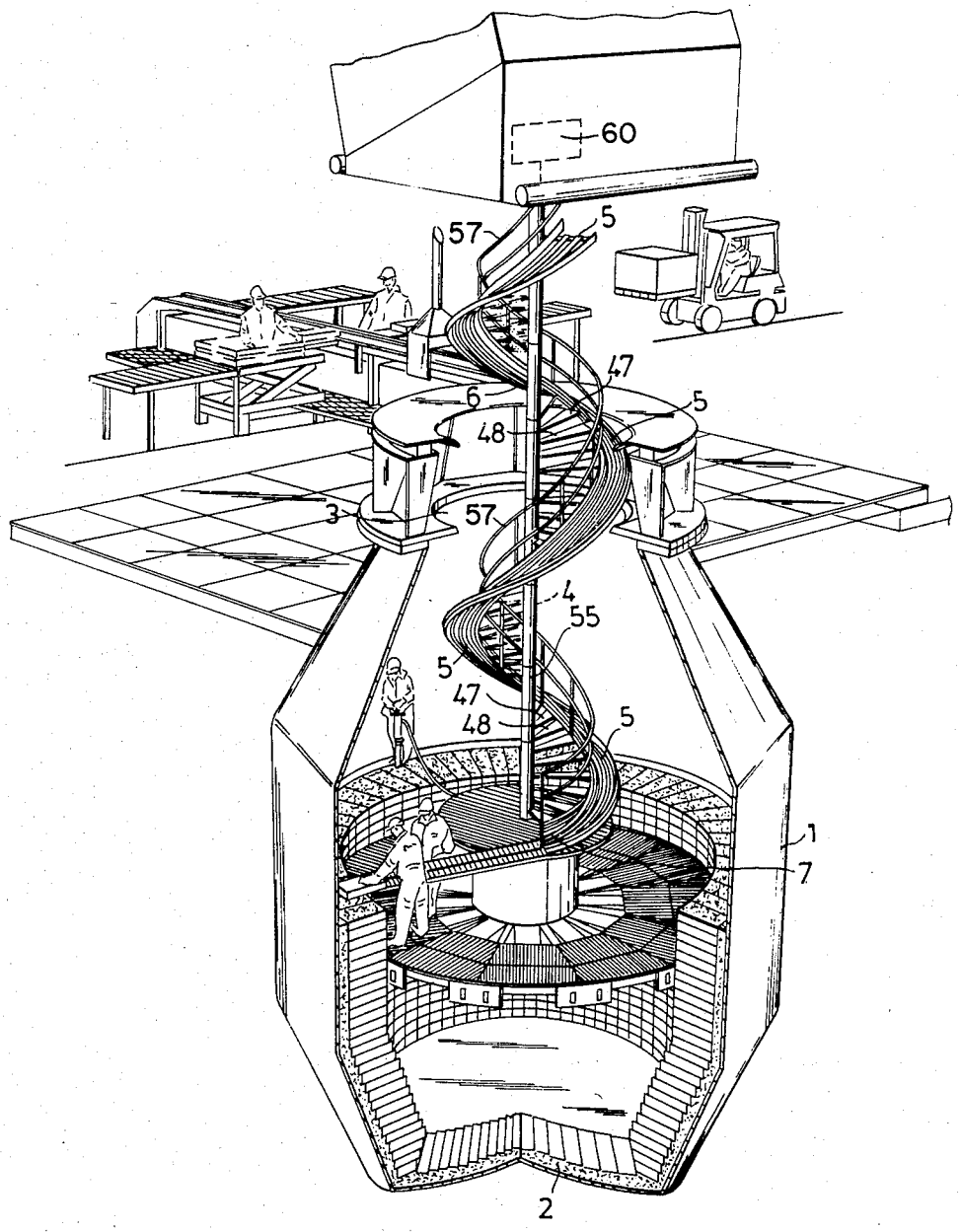
Figure 11:
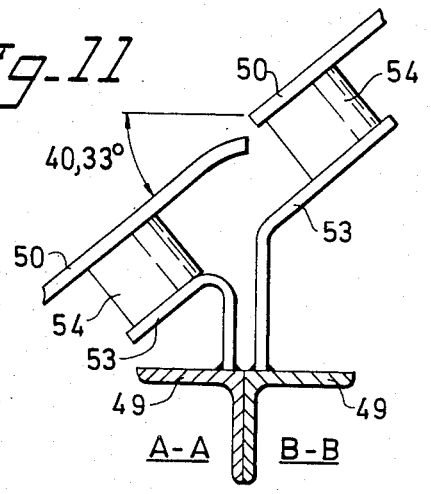
Figure 12:
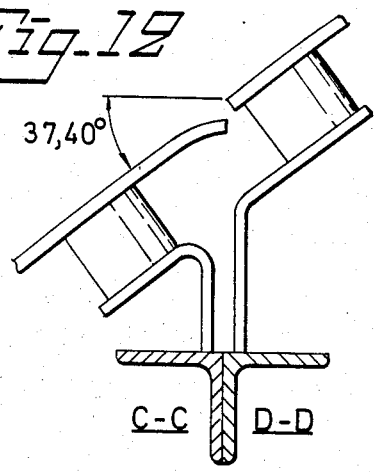
Figure 13:
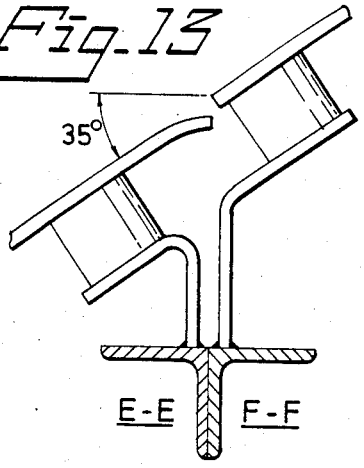
Figure 14:
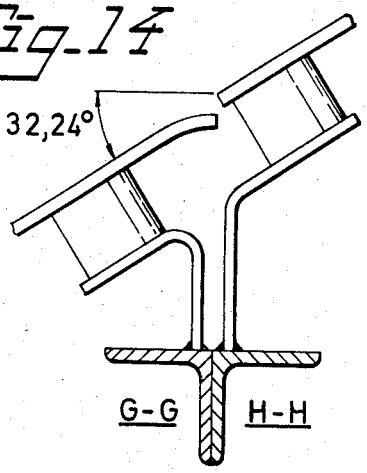
Figure 15:
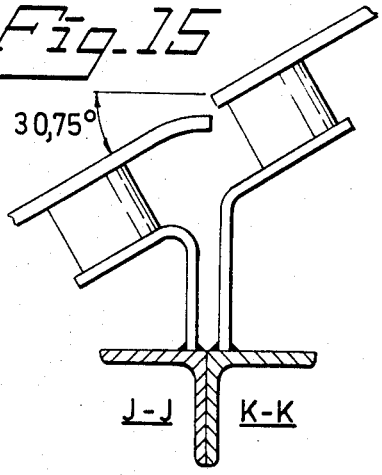

The invention is described in greater detail in the following, with reference to an embodiment thereof and to the accompanying drawings, in which FIG. 1 is a view of a schematically shown arrangement according to the invention attached in a converter, FIG. 2 shows, among other things, a feed conveyor intended to be connected upwardly to the right in FIG. 1, FIG. 3 is a section A—A accoording to FIG. 1 through a joint between path sections according to the invention, FIG. 4 is a section B—B according to FIG. 5 through a schematically shown and partially folding work platform, FIG. 5 shows the platform portion according to FIG. 4 seen from above in FIG. 4, FIG. 6 is a partially exploded perspective view of an arrangement according to the invention where a winding staircase is provided, FIG. 7 shows a path and staircase section according to the invention seen from above, FIG. 8 shows the section according to FIG. 2 seen from the right in FIG. 2, FIG. 9 shows a part of an outer upper end portion of the section according to FIGS. 2 and 3, FIG. 10 shows a part of an outer lower end portion of the section according to FIGS. 2 and 3, and FIGS. 11-15 are sections A—A and B—B, C—C and D—D, E—E and F—F, G—G and H—H, and I—I and K—K, respectively, according to FIG. 7.

In FIG. 1 the numeral 1 designates a converter, which is being lined and comprises a stationary bottom 2 and upwardly a mouth 3. 4 designates a carrying device, which preferably consists of a lance 4 or corresponding member intended to be inserted downward into the converter and be lifted and lowered by means 60 (FIG. 6), known per se, for example means located above the converter and intended to be used for the control of a lance associated with the converter for oxygen injection or corresponding function.

5 designates a conveying device for substantially vertical transport of material transferred to the conveying device. The conveying device consists of a substantially helical slither plate, chute or corresponding means, a slide, along which material supplied at an upper portion 6 of said path 5 is intended to slide.

A feed conveyor 8, FIGS. 1 and 2, is provided in connection to a storey 7 on the same level as the converter mouth and intended to supply material, for example shaped bricks. Material 9 is supplied to said conveyor 8, for example, manually from pallets 10. 11 designates a cleaning sluice, through which the conveyor runs, and 12 is a transfer member, for example a rotary table, located in connection to the conveyor 8 and upper portion 6 of the path 5 where scrapers or the like are provided for transferring material in known manner to the table 12 and from there to the path 5.

The path 5 extends helically about said lance 4 to a position in connection to the lower portion 13 of the lance. The lance carries at said lower portion a work platform 14, which will be described in greater detail below. According to a preferred embodiment, the path 5 opens by an end portion 15 on a level suitable from a work aspect above the work platform 14, where a transfer way, for example a roller way 16, is provided in connection to said end portion and preferably attached thereto. Said transfer way 16 is intended to transport material to a consumption place 17, a bricklaying station, and extends between the end portion 15 and the place of consumption. The transfer way 16 preferably is mounted hingedly at its end 18 connecting to the end portion, so that the end 9 located adjacent the consumption place and by means of a support roller 20 or the like intended to rest on the wall crown 21 can be maintained on a definite level even when the end 16 connected to the end portion 15 is lifted or lowered, and so that, for example, cardboard can be laid out as dilation material on the wall crown.

According to the invention, said path 5 is mounted rotatably about a substantially vertical axle, so that a lower portion, the said end portion 15, can be caused to assume an optional position in the circumferential direction of the converter or corresponding apparatus. At the embodiment shown in FIG. 1, the transfer path assumes a corresponding position, which normally is intended to be connected to the consumption place 17. For obtaining the said rotatability, the lance 4 can be mounted rotatably, for example, by mounting 22 in connection to the platform 14, in such a manner, that the path 5 is attached to the lance 4 and caused by the lance to rotate. The path 5 may also be mounted attached to the lance whereby the path can be rotated about the lance.

According to a preferred embodiment, the path 5 is assembled of sections 23 intended to be positioned adjacent one another in vertical direction and be connected one to the other, so that a continuous helical path is formed, and in such a manner, that the total height of the path can be varied by adding or removing sections in connection to one end of the path in pace with the displacement of the consumption place in vertical direction in the converter or corresponding apparatus. At the embodiment shown in FIG. 1, the adding or removing preferably is carried out at the upper portion of the path which is connected to the conveyor 8.

In FIG. 3 an imaginative design of the attachment and mounting of sections 23 is shown. About the lance 4 a mounted attachment 24 is provided, at which an upper 26 and a lower 25 section 23 is intended to be positioned by means of flanges 27 and screw connection or in a corresponding manner. Each section can be imagined comprising a semi-cylindric tube member 28 extending between two adjacent attachments in vertical direction. At each member 28, for example, two radially extending carrying stay members 29,30, an upper one 29 and a lower one 30, are provided for carrying the path proper, which dashed stay members 29,30 are located above the section plane.

The work platform 14 preferably is of "flaky" type and foldable to a large extent. The platform according to FIGS. 4 and 5 comprises a number of radially directed supporting arms 31, which are attached hingedly to a central portion 32 and assembled of, for example, three partial portions 33–35, of which the outer one 35 can be inserted into the central one 34, which in its turn can be inserted into the inner one. A telescopic cylinder 36, for example, or corresponding member is provided and intended to act between the outer portion 35 and a supporting piece beneath the inner portion 33 for moving the portions 33–35 into and out of each other. Each arm 31 can be folded by means of a cylinder 37 or corresponding member to a position shown by dashed line in FIG. 4 where the portions 34,35 are inserted into the portion 33. Above and between the arms 31 flakes 38, floor elements 38, are provided so as in an apparent manner be moved over adjacent flakes 38 when the platform is being folded together. For space reasons, certain outer flakes must be removed for rendering the platform to be folded together entirely. At the outer end 39 of each arm 31 wheels 40 or corresponding means are provided and intended, in applicable cases, to run against the inner shell surface 41 of the converter or corresponding apparatus.

In FIG. 1 the numeral 42 designates an extension of the path 5, preferably in the form of an additional portion of helical path located in connection to the lower portion 15 of the path 5, which extension is provided for the transport of material to a level below the work platform, for example to the converter bottom 2.

The numeral 43 designates a ladder of telescopic type. Preferably also a communication equipment 44, indicated in FIG. 1, is provided for communication between the consumption place and feed place, by which equipment material delivery can be requested, its receipt be acknowledged and recorded.

In order to facilitate rotation of the path 5, the driving can be arranged at the lance, if it is rotatable, or at the path 5. For illustrating the firstmentioned alternative, a drive equipment 45 is indicated in FIG. 1. For carrying the end portion and way 16, a supporting ring 46 or corresponding member can be provided at the platform, along which ring 46 the end portion and way end 18 are movable.

According to a preferred embodiment of the invention, a substantially helical staircase 47 or corresponding means is provided, along which operators can walk down into and up out of the converter. Said staircase 47 runs in connection to said path 5.

According to a preferred embodiment, the staircase 47 is connected to the path 5 and runs in parallel with and at the same pitch as the path 5.

At the variant of such as embodiment shown in FIGS. 6–15, the staircase 47 runs with steps 48 inside said path 5, in such a manner, that the steps of the staircase 47 run substantially radially from said central axle, lance 4 or corresponding member, comprised in said carrying member 4, and outward to the path 5. Said steps 48 preferably are connected to and substantially radially projecting from said lance 4 or corresponding member in a successive helical path, in such a manner, that supports 49 for said path 5 project substantially radially from at least certain steps, on which supports 49 the path 5 is located, as shown in greater detail in FIGS. 7–15.

At the embodiment shown in FIGS. 6–15, the path 5 is broken and consists of a plurality of portions 50 running along the path and in spaced relationship with each other. The path further comprises inner edge portions 51 and outer edge portions 52, which also are broken. In connection to the supports 49, the path portions 50 are located on angular supporting members 53 adjusted to the inclination of the path, at which members the path portions 50 are attached by means of preferably resilient distance members 54, such as rubber blocks.

Preferably also said edge portions 51,52 are attached at resilient distance members 54.

At the preferred embodiment shown in FIGS. 6–15, the path 5 and staircase 8 are assembled of sections 55, each of which comprises both a path portion and a staircase portion. The sections are intended to be positioned adjacent one another in vertical direction and be connected to each other, so that a continuous path and staircase are formed, and so that the height of the path and staircase can be varied by adding or removing sections in connection to one end of the path. The sections, FIGS. 7–15, preferably are capable to be joined to each other at at least one separate support 49 located at the lower path end 56 of each section, which support is intended to be connected to a support 49 projecting from the upper step 48 of the next section, as shown for example in FIG. 11.

In respect of suitable dimensions, pitch etc. at the embodiment shown in FIGS. 6–15, the inner radius of the path is about 700 mm and the outer radius of the path is about 1.180 mm, and the pitch is about 4.000 mm per winding. The path is located about 300 mm above the path of the staircase 47. Other dimensions, of course, can be imagined.

It also is possible to imagine embodiments, sectioned or not, where said staircase 47 runs above the path 5, overlapping the same and preferably in parallel therewith in an apparent manner. According to a preferred such embodiment, portions of the staircase, for example portions located beneath the steps 48 and running along the staircase and corresponding to the path portions 50, cover the path 5 entirely or partially, whereby obviously a sealing is obtained which prevents material from leaving the path in an undesired direction.

The function of the arrangement according to the invention should have become apparent substantially from the aforesaid.

The lance 4 and platform 14 are assembled preferably outside the converter, whereafter the lance and platform are positioned and mounted above the converter mouth 3. Thereafter the lance and the platform, which here is in folded together position, are lowered in steps down into the converter, and the path and, in applicable cases, the staircase 47 are mounted one section after the other at the lance. Preferably also, in applicable cases, the ladder 43 is mounted. When the lance and platform have been lowered to a suitable level, for example 3.5 m from clean converter bottom, the platform can be unfolded entirely, and the roller way 16 or corresponding means can be positioned. Preferably simultaneously with the successive lowering of the lance, the peripheral equipment, the conveyor 8, transfer member 12 etc. are mounted at the converter mouth. In applicable cases also the extension 42 is mounted.

At the bricklaying operation, material, shaped bricks, are fed one by one upon request from the conveyor 8 and transferred to the path 5 and further to the consumption place. Means for braking the bricks prior to their arrival at the consumption place preferably are provided. These means, for example, may consist of the lower windings of the path which for this purpose in an apparent way (not shown) are designed with a pitch, inclination, lower than the remaining windings of the path. Also a brake block or braking rollers or the like can be imagined separate or in different combinations. Upon demand, i.e. as the bricklaying proceeds, the path 5 and therewith the roller way 16 can be rotated and moved in circumferential direction of the converter. The roller way 16 preferably can be extended and shortened to adjust to the inner diameter of the converter. In pace with the increasing height of the wall edge 21, also the lance, path 5 and platform are elevated, and differences in level can be taken up by the hinged attachment of the roller way 16. The lance and path preferably are raised in steps corresponding to the height of a section 23, so that one section at a time can be dismounted above the mouth 3. For feeding material to the bottom 2, the path 5 is rotated to be connected to the extension 42.

As should have become apparent from the above description, the arrangement, compared to known arrangements, is a simple and thereby inexpensive solution when a consumption place in a converter or the like is to be supplied with primarily shaped bricks in a definite order and with protective treatment of the bricks. The number of handling steps, thus, is small. Furthermore, the dead weight of the material is utilized for the transport in vertical direction. The movements on foot down into and up out of the converter are solved by the winding staircase 47 in a simple and much expedient manner, which movements normally are a problem, for example for space and safety reasons.

The invention has been described above with reference to one embodiment. More embodiments and minor alterations and complementary measures, of course, can be imagined without abandoning the invention idea. The peripheral equipment, for example, is shown adapted to the embodiment shown and must be adapted in each individual case.

The embodiments of the arrangement described above are adapted to a converter 1 or corresponding apparatus with stationary bottom. The arrangement, of course, can be adapted to a converter or corresponding apparatus with removable bottom. In that case the carrying device with platform and helical path 5 can be inserted from below through the bottom opening of the converter. Material can then be supplied to the path from a vertical conveyor, by which material is transported upward through the bottom. When possible from a space aspect etc., material also can be supplied from above, in which case substantially the same arrangement as shown in FIG. 1 is used, with the difference, however, that the platform etc. are supported from below.

The staircase 47, of course, can run outside said path. The staircase, further, need not run along the path 5 with the same pitch as the path, but can be imagined to run in a different way (not shown). The staircase also can be designed more like a ladder, with pins or the like instead of marked steps. The staircase preferably comprises a supporting railing 57 (FIG. 6). It is also imaginable that the staircase is supported in a way other than by said carrying device.

The path design as shown in FIGS. 6–15, of course, is more generally applicable and can be used also at other staircase configurations, for example at one configuration, at which the staircase runs above the path 5, in which case suitable means corresponding to the supports are provided for carrying the path, and also when there is no winding staircase.

The invention, thus, must not be regarded restricted to the embodiments described above, but can be varied within the scope of the attached claims.

I claim:

1. An arrangement for the transport of lining materials, for example, shaped bricks and the like, for the lining of the interior walls of ladles, converters, blast furnaces or the like where the transport of the materials is intended to take place between a supply place, usually located outside the converter or corresponding apparatus, and a consumption place, for example, a bricklaying station adjacent an inner wall in the converter or corresponding apparatus, comprising: a vertically adjustable carrying device and a conveying device for substantially vertical transport of material transferred to the conveying device, and means for advancing to the consumption place material, which was transported down by said conveying device, and a work platform supported at least in part by said carrying device for vertical movement therewith, characterized in that said conveying device consists of a substantially helically shaped slither plate path (5) which is a chute, a slide or corresponding device, in itself substantially known per se, along which material supplied at an upper portion (6) of said path (5) is intended to slide, said helical path (5) being vertically adjustable along and rotatable about a substantially vertical axis, preferably about a vertically arranged lance (4) or corresponding means constituting said carrying device, so that a lower portion of the path (5) located at a suitable height above the work platform (14), from which portion material is intended to be transferred to the consumption place (17), can be caused to assume an optional position in the circumferential direction of the converter (1) or corresponding apparatus, said means for advancing material to the consumption place (17) consisting of an end portion (15) of the path (5) and a transfer way (16), for example a roller way (16), which is connected to said end portion (15) and attached to said path (5), preferably at said end portion, for vertical and rotational movement therewith, and which extends between said end portion (15) and the consumption place (17).

2. An arrangement as defined in claim 1, characterized in that said path (5) is assembled of sections (23,55) intended to be located adjacent one another in vertical direction and be connected to each other, so that a continuous path (5) is formed, and so that the height of the path can be varied by adding or removing sections in connection to one end of the path in pace with the displacement of the consumption place (17) in vertical direction in the converter or corresponding apparatus.

3. An arrangement as defined in claim 1, characterized in that said transfer way (16) is hingedly mounted at one end (18) to said end portion (15), so that the end (19) of the transfer way (16) located adjacent the consumption place (17) can be maintained on a definite level when the helical path (5) is lifted or lowered.

4. An arrangement as defined in claim 1, characterized in that said lance (4) or corresponding device is rotatable, and that said path (5) is attached to the lance (4) and thereby rotatable with the same.

5. An arrangement as defined in claim 1, characterized in that said path (5) is rotatably mounted on said lance (4) and thereby rotatable about the lance.

6. An arrangement as defined in claim 1, characterized in that an extension (42) of the helical path (5) is provided, which preferably has the form of an additional portion (42) of the helical path (5) located in connection to the lower portion (15) of the helical path, which extension (42) is intended to transport material to a level beneath said work platform (14), for example to the bottom (2) of the converter or corresponding apparatus.

7. An arrangement as defined in claim 1, characterized in that material conveyed along the path (5) is intended to be braked prior to its arrival at the consumption place (17) by adapting the pitch, inclination, of the path at least in the lower path portion.

8. An arrangement as defined in in claim 1, characterized in that material is intended to be transferred to the path (5) by means of a rotary table (12) in connection to the upper portion (6) of the path (5), and that scrapers or the like are provided for transferring material from the table to the path.

9. An arrangement as defined in claim 1, characterized in that said path (5) is broken and consists of a plurality of path portions (50) running along the path in spaced relationship to each other, and that the path comprises inner (51) and outer (52) edge portions.

10. An arrangement as defined in claim 9, characterized in that the path portions (50), mounted on supports (49) or corresponding members connected to said carrying device (4), are supported on angular supporting members (53) adjusted to the inclination of the path (5), at which supporting members the path portions (5) are attached by preferably resilient distance members (54), for example rubber blocks (54).

11. An arrangement as defined in claim 1, characterized in that in connection to said path (5) a substantially helical staircase (47) or corresponding device runs, which preferably is carried by said carrying device (4), and along which operators can move on foot down into and up out of the converter (1) or corresponding apparatus.

12. An arrangement as defined in claim 11, characterized in that the staircase (47) is connected to the path (15) and runs in parallel therewith and has the same pitch as the same.

13. An arrangement as defined in claim 11, characterized in that the staircase (47) is assembled of sections (55), located preferably at path sections, so that a continuous staircase (47) can be formed.

14. An arrangement as defined in claim 11, characterized in that the staircase (47) runs inside the path (5), and steps (48) of the staircase run substantially radially in the direction from a central lance (4) or corresponding device of which the carrying device (4) is comprised, and outward to the path.

15. An arrangement as defined in claim 11, characterized in that the staircase (47) runs above the path and in connection thereto, and that portions of the staircase (47) cover the path (5) preferably entirely or partially, whereby a sealing is obtained which prevents material from leaving the path.

16. A transport arrangement as defined in claim 1, characterized in that said lance (4) is vertically adjustable by means of devices located above the converter or corresponding apparatus, said devices being conventionally used for the control of an apparatus associated with the converter for oxygen injection or corresponding function.

* * * * *